United States Patent [19]

Lee

[11] Patent Number: 4,783,076

[45] Date of Patent: Nov. 8, 1988

[54] FISHING-CRAB TOYS

[76] Inventor: Ching H. Lee, 14, Hsin Ping Rd., Tainan City, Taiwan

[21] Appl. No.: 29,814

[22] Filed: Mar. 25, 1987

[51] Int. Cl.[4] ..... A63F 9/00

[52] U.S. Cl. ..... 273/1 GG

[58] Field of Search ..... 273/1 GG, 1 GD, 140

[56] References Cited

U.S. PATENT DOCUMENTS

| | | | |
|---|---|---|---|
| 346,892 | 8/1886 | Bullock | 273/140 |
| 420,149 | 1/1890 | Elson | 273/140 |
| 626,995 | 6/1899 | Haigh | 273/140 |
| 1,162,637 | 11/1915 | Moad | 273/140 |
| 2,496,096 | 1/1950 | Kelley | 273/140 |
| 2,611,617 | 9/1952 | Strohm | 273/140 |
| 3,788,641 | 1/1974 | Lemelson | 273/1 GG X |
| 4,214,750 | 7/1980 | Shimizu | 273/140 X |
| 4,298,199 | 11/1981 | Bush et al. | 273/1 GG X |

FOREIGN PATENT DOCUMENTS 1186225 10/1985 U.S.S.R. ..... 273/1 GG

*Primary Examiner*—Paul E. Shapiro

*Attorney, Agent, or Firm*—Holman & Stern

[57] ABSTRACT

This fishing-crab toy consists of a round plate made up of an upper plate and a lower plate, a plurality of toy crabs and a fishing rod. The upper plate has a plurality of round holes for toy crabs to be put in, and can be turned around. But the lower plate is immovable and a plurality of rising-up-and-down rails are set on them in order to raise up or lower down the crabs when the upper plate is turned around. Each of the crabs has two claws and two tooth bases with a hook tooth, and they are connected together with a pin and can be bended up or stretched out downward. As the upper plate is made to turn around and the crabs are raised up with their claws and tooth bases are stretched out downward, a player can fish up one of the crabs hooking the triangle frame with the tooth base.

3 Claims, 3 Drawing Sheets

FISHING-CRAB TOYS

BACKGROUND OF THE INVENTION

This invention concerns a kind of toy of fishing a crab.

Toys plan an important role in the growth of children supplying them with recreation and enlightment as well. So toy makers always make much of its design so that it can give children much interest and enlightment. Conventional fishing toys are generally liked by children, but often the way of fishing is too simple to keep children's pleasure in playing for a long time. For example, an iron piece is set on the top of the head of a toy fish or octopus, and a magnet is set in the cap attached with a fishing rod; a toy fish is put in one of the holes of a round plate, and the toy fish can be raised up by a rising-up-and-down rail set on a lower plate as the round plate turns around; a player handles a fishing rod adjusting the cap to cover the head of the toy fish and making the magnet of the cap suck the iron piece of the head as the toy fish is gradually raised up to the highest point by the rail with turning movement of the round plate; then the player can fish or pull up the toy fish, acquiring the enjoyment of fishing.

Although the fishing toy just mentioned above can interest children, but the method of playing is too simple and short of realistic feeling because fishing is done by sucking force of magnetism. Additionally, toy fish sometimes fall down owing to the swinging of the fishing string even if they have been pulled up.

Children may be tired of playing this kind of fishing toy because of the simplicity in playing after they have played with it for a certain period of time.

SUMMARY OF THE INVENTION

So the inventor has worked out this new kind of fishing toy, aiming to supply children with a more complicated structure to attract them for a longer time.

This fishing-crab toy includes a round plate with holes on its surface and one toy crab is put in each hole and can be raised up by a rising-up-and-down rail for a player to fish it up with a fishing rod fastened with a string tied with a triangle frame as the round plate is turned around. But the player has to have a little skill and practice before he/she can play it well, as it has a little complicated way that the crab can be fished up.

DETAILED DESCRIPTION OF THE INVENTION

This toy consists of round plate 1, toy crabs 2 and fishing rod 3 as its main parts.

Figure 1:
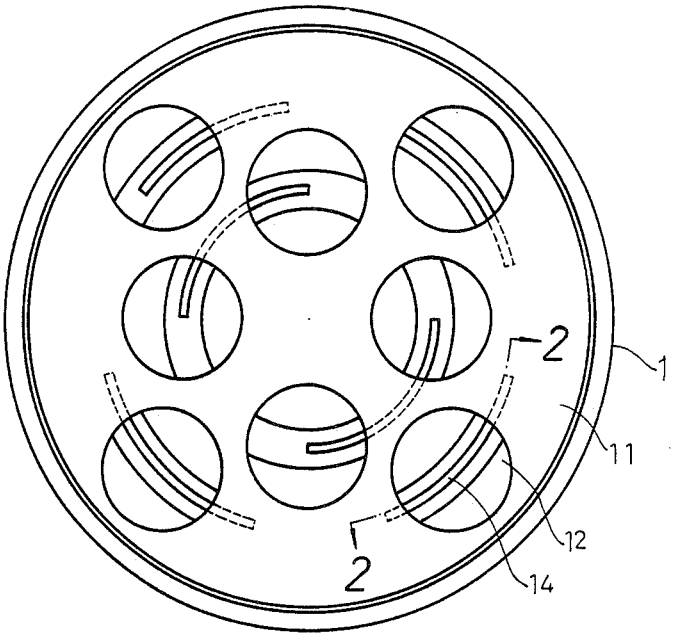
FIG. 1 is a view of the round plate in this invention.
Figure 2:
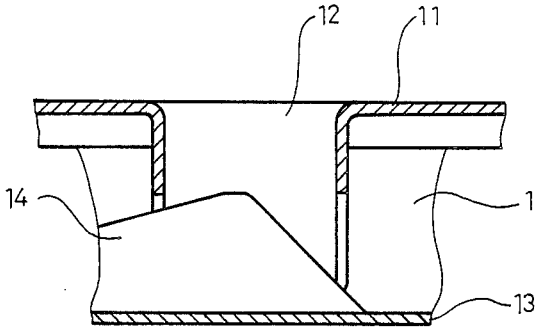
FIG. 2 is a cross-sectional view of the round plate in this invention.

Round plate 1, as FIGS. 1, 2 show, has the same structure as common fishing toys including upper plate 11, holes 12 for putting in toy fish, lower plate 13, rising-up-and-down rails 14 and a transmission set. The transmission set is responsible for turning around upper plate 11 but its description is ommitted as it is not claimed in this invention.

Figure 3:
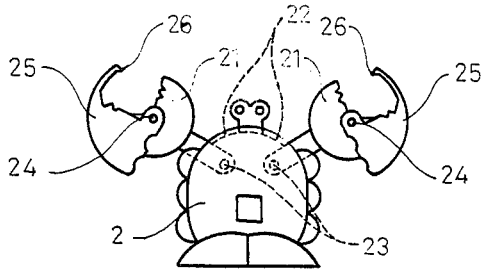
FIG. 3 is a front view of the toy crab in this invention.

Each toy crab 2, as shown in FIG. 3, has two movable claws 21 set on their body; rectangular notch 22 is cut on the body where claws 21 stretch out, and claws 21 can swing to and fro within notch 22 with pin 23 function as a pivot; on claws 21 are set tooth bases 25 that can swing to and fro with pin 24 function as a pivot, and pin 24 also combines claws 21 together with tooth bases 25 which have a little bending-inside hook tooth 26. Claws 21 and tooth bases generally stretch out downward because of its design when they are not put in holes 12 of round plate 11.

Figure 4:
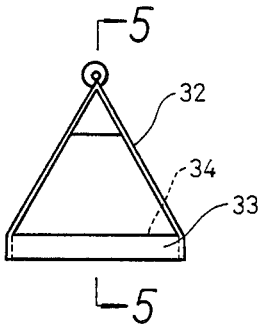
FIG. 4 is a front view of the triangle frame in this invention.
Figure 5:
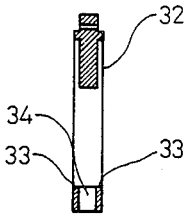
FIG. 5 is a cross-sectional view of 5—5 line on FIG. 4.
Figure 6:
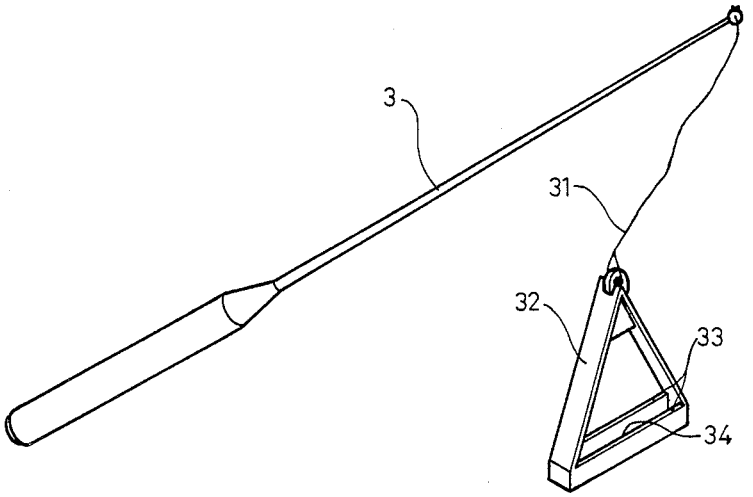
FIG. 6 is an actional view of this toy.

Fishing rod 3, as shown in FIG. 6, is fastened with string 31 whose tip is tied with triangle frame 32. FIGS. 4, 5 show the structure of triangle frame 32, which includes two parallel rods 33 as its bottom side of the frame; there is empty space 34 between two parallel rods 33. Besides, decorative bait 35 is to be hung inside triangle frame 32.

Figure 7:
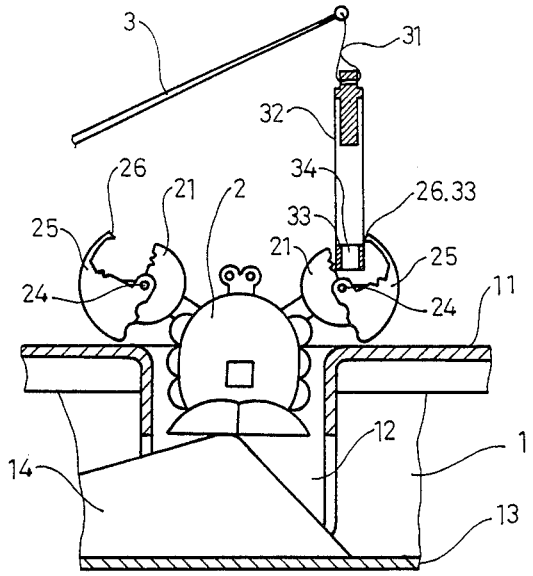
FIG. 7 is another actional view of this toy.
Figure 8:
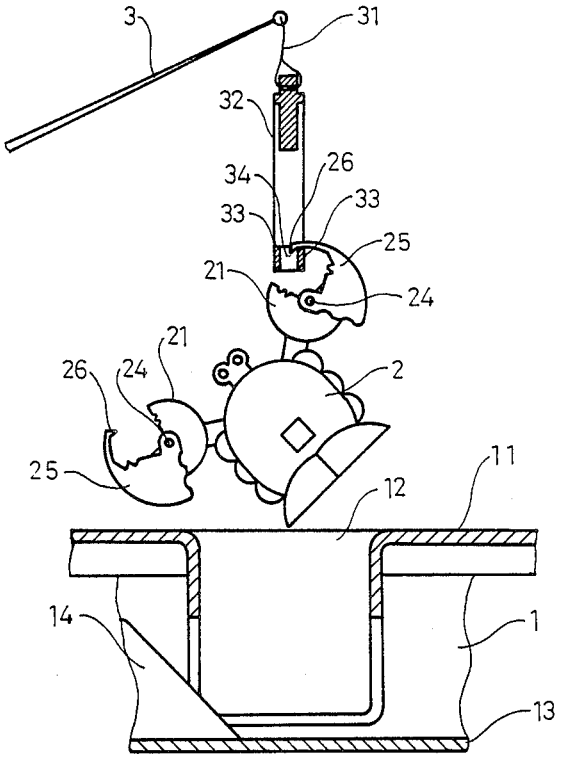
FIG. 8 is a view of this toy was fished up.

In playing this toy, each toy crab 2 is to be put in each hole 12 of round upper plate 11, and claws 21 and tooth bases 25 are to be bended up by hole 12 because of the smaller diameter of hole 12 than the stretching-out scope of claw 21 and tooth base 25. Then upper plate 11 is able to turn around by means of the transmission set of round plate 1, and toy crabs will be raised up or lowered down by rising-up-and-down rails set on lower plate 13. When toy crabs 2 are raised up with their claws 21 and tooth bases 25 stretching out downward as shown in FIG. 7, a player lowers down triangle frame 32 of fishing rod into the empty space between claw 21 and tooth base 25 after toy crab 2 has passed the highest point of rail 13 and fallen down with claw 21 and tooth base 26 being bended up; the player can pull up triangle frame 32 making hook tooth 26 of tooth base 25 stuck in empty space 34 between two parallel rods 33. Thus the process of playing this toy has been finished as shown in FIG. 8 and pleasure in fishing it could be enjoyed by the player. Meanwhile, when toy crab 2 is being pulled up, hook tooth 26 is to swing inward because of its own weight so toy crab 2 cannot fall down. After crab 2 has been fished up, it needs to be released from triangle frame 32 for replay and holding up crab 2 and separating hook tooth 26 from empty space 34 of two parallel rods 33 can do it.

What is claimed is:

1. A fishing toy comprising;

a holder for toy crabs including a rotatable upper plate with a plurality of holes for receiving toy crabs therein, and a stationary lower plate with a raising and lowering rail for raising and lowering toy crabs which are located in said holes when the upper plate is rotated;

toy crabs for positioning in said holes, each crab having claws and associated hooked tooth members;

a fishing rod with a string and a triangular frame at a free end of the string for hooking the crabs when they are raised in the respective holes by said rail, the frame having an apex by which it is secured to the string and a base comprising to parallel rods with a space therebetween for catching the hooked tooth members of the respective toy crabs.

2. The invention of claim 1, wherein the hooked tooth members are pivotally mounted on the respective claws.

3. The invention of claim 2, wherein each crab includes a crab body and the claws are pivoted on the body.

* * * * *